US007942707B2

(12) United States Patent
Orris et al.

(10) Patent No.: US 7,942,707 B2
(45) Date of Patent: May 17, 2011

(54) ELECTRICAL CONTACT WITH LOCKING BARB

(75) Inventors: David Patrick Orris, Middletown, PA (US); William Crusey Van Scyoc, Shippensburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/431,397

(22) Filed: Apr. 28, 2009

(65) Prior Publication Data

US 2010/0273363 A1 Oct. 28, 2010

(51) Int. Cl.
*H01R 13/432* (2006.01)

(52) U.S. Cl. ..... 439/748; 439/752.5

(58) Field of Classification Search ..... 439/748, 439/745, 752.5, 744, 733.1, 578
See application file for complete search history.

(56) References Cited

U.S. PATENT DOCUMENTS

| | | | | |
|---|---|---|---|---|
| 3,783,440 | A * | 1/1974 | Karube et al. | 439/748 |
| 3,808,590 | A | 4/1974 | Hemmer et al. | |
| 3,957,337 | A * | 5/1976 | Damiano | 439/682 |
| 4,010,993 | A * | 3/1977 | Hohenberger et al. | 439/176 |
| 4,139,255 | A * | 2/1979 | Otani | 439/748 |
| 5,389,013 | A | 2/1995 | Kourimsky | |
| 5,934,945 | A * | 8/1999 | Petersen et al. | 439/744 |
| 7,249,983 | B2 * | 7/2007 | Meyer et al. | 439/878 |

* cited by examiner

*Primary Examiner* — Hien Vu

(57) ABSTRACT

An electrical contact includes a body extending a length from a contacting end to a terminating end. The body includes a base extending between the contacting and terminating ends. A passageway extends through at least a portion of the length of the body. A locking barb is connected to the base of the body. The locking barb extends a length from an engagement end to a locking end. The locking barb is connected to the base of the body at a pivot point located along the locking barb between the engagement and locking ends. The locking barb is pivotable about the pivot point between a locked and an unlocked position. The engagement end of the locking barb extends into the passageway of the body when the locking barb is in the locked position.

19 Claims, 4 Drawing Sheets

ELECTRICAL CONTACT WITH LOCKING BARB

BACKGROUND OF THE INVENTION

The subject matter described and/or illustrated herein relates generally to electrical contacts, and, more particularly, to electrical contacts that include one or more locking barbs that hold the electrical contact within an electrical connector housing.

Some electrical contacts are held within the housing of the associated electrical connector using resilient locking barbs. For example, the locking barbs may extend radially outward from a base of the electrical contact. As the electrical contact is inserted into the electrical connector housing, engagement between the locking barbs and the housing resiliently compresses the locking barbs radially inward toward the electrical contact base. Once the locking barbs pass an internal shoulder of the electrical connector housing, the resilient locking barbs spring radially outward into engagement with the internal shoulder. Engagement between the locking barbs of the electrical contact and the shoulder of the electrical connector housing prevents removal of the electrical contact from the housing in at least one direction.

To remove the electrical contact from the electrical connector housing, the resilient locking barbs are compressed radially inward relative to the electrical contact base until the locking barbs clear the internal shoulder of the electrical connector housing. At least some known electrical connectors therefore include a retaining clip positioned within the electrical connector housing between the housing and the electrical contact. The retaining clip is slidable along a length of the electrical contact. To remove the electrical contact from the electrical connector housing, the retaining clip is slid over the locking barbs to thereby compress the locking barbs radially inward relative to the electrical contact base. The retaining clip holds the locking barbs in an unlocked position wherein the locking barbs clear the internal shoulder of the electrical connector housing, such that the electrical contact can be removed from the housing. However, the retaining clip increases the number of components of the electrical connector, which may increase a cost of the electrical connector and/or a difficulty of assembling the electrical connector. Moreover, a handle or other portion of the retaining clip that is grasped to slide the retaining clip over the locking barbs may only be accessible at a rear end of the electrical connector that terminates the end of a cable or is mounted on a circuit board (as opposed to a front end that mates with a mating connector). Adequate space may therefore need to be provided at the rear end of the electrical connector to enable a person to grasp the retaining clip with a tool or a person's hand.

BRIEF DESCRIPTION OF THE INVENTION

In one embodiment, an electrical contact includes a body extending a length from a contacting end to a terminating end. The body includes a base extending between the contacting and terminating ends. A passageway extends through at least a portion of the length of the body. A locking barb is connected to the base of the body. The locking barb extends a length from an engagement end to a locking end. The locking barb is connected to the base of the body at a pivot point located along the locking barb between the engagement and locking ends. The locking barb is pivotable about the pivot point between a locked and an unlocked position. The engagement end of the locking barb extends into the passageway of the body when the locking barb is in the locked position.

The passageway optionally extends through the length of the body along a central longitudinal axis. The passageway is optionally at least partially defined by an interior wall of the body, wherein the engagement end of the locking barb extending closer to the central longitudinal axis than the interior wall when the locking barb is in the locked position. Optionally, the body includes an exterior wall, wherein at least a portion of the locking end of the locking barb extends further from the central longitudinal axis than the exterior wall when the locking barb is in the locked position.

Optionally, the base of the body includes an opening extending therethrough, wherein the locking barb extends through the opening. The engagement end of the locking barb may include engagement surface configured to engage a removal tool within the passageway of the body for moving the locking barb from the locked position to the unlocked position. In some embodiments, the body includes an interior wall that at least partially defines the passageway and an exterior wall opposite the interior wall, wherein the engagement end of the locking barb extends inwardly from the pivot point past the interior wall of the body when the locking barb is in the locked position, and wherein the locking end of the locking barb extending outwardly from the pivot point past the exterior wall of the body when the locking barb is in the locked position.

The locking barb is optionally resiliently movable from the locked position to the unlocked position against a bias of the locking barb. In some embodiments, the locking end of the locking barb extends approximately coplanar with an adjacent portion of the base of the body when the locking barb is in the unlocked position. Optionally, the base of the body includes an opening extending therethrough, wherein the opening is defined by an opening surface and the locking barb is connected to the opening surface at the pivot point. The contacting end of the body optionally includes a plug that is configured to be received within a receptacle of a mating contact. The locking barb is optionally formed integrally with the body.

In another embodiment, an electrical connector is provided. The electrical connector includes a housing having an internal cavity including a locking shoulder, and an electrical contact held at least partially within the internal cavity of the housing. The electrical contact includes a body extending a length from a contacting end to a terminating end. The body includes a base extending between the contacting and terminating ends. A passageway extends through at least a portion of the length of the body. A locking barb is connected to the base of the body. The locking barb extends a length from an engagement end to a locking end. The locking barb is connected to the base of the body at a pivot point located along the locking barb between the engagement and locking ends. The locking barb is pivotable about the pivot point between a locked position and an unlocked position. The locking end of the locking barb is engaged with the locking shoulder of the housing when the locking barb is in the locked position. The engagement end of the locking barb extends into the passageway of the body when the locking barb is in the locked position.

DETAILED DESCRIPTION OF THE INVENTION

Figure 1:
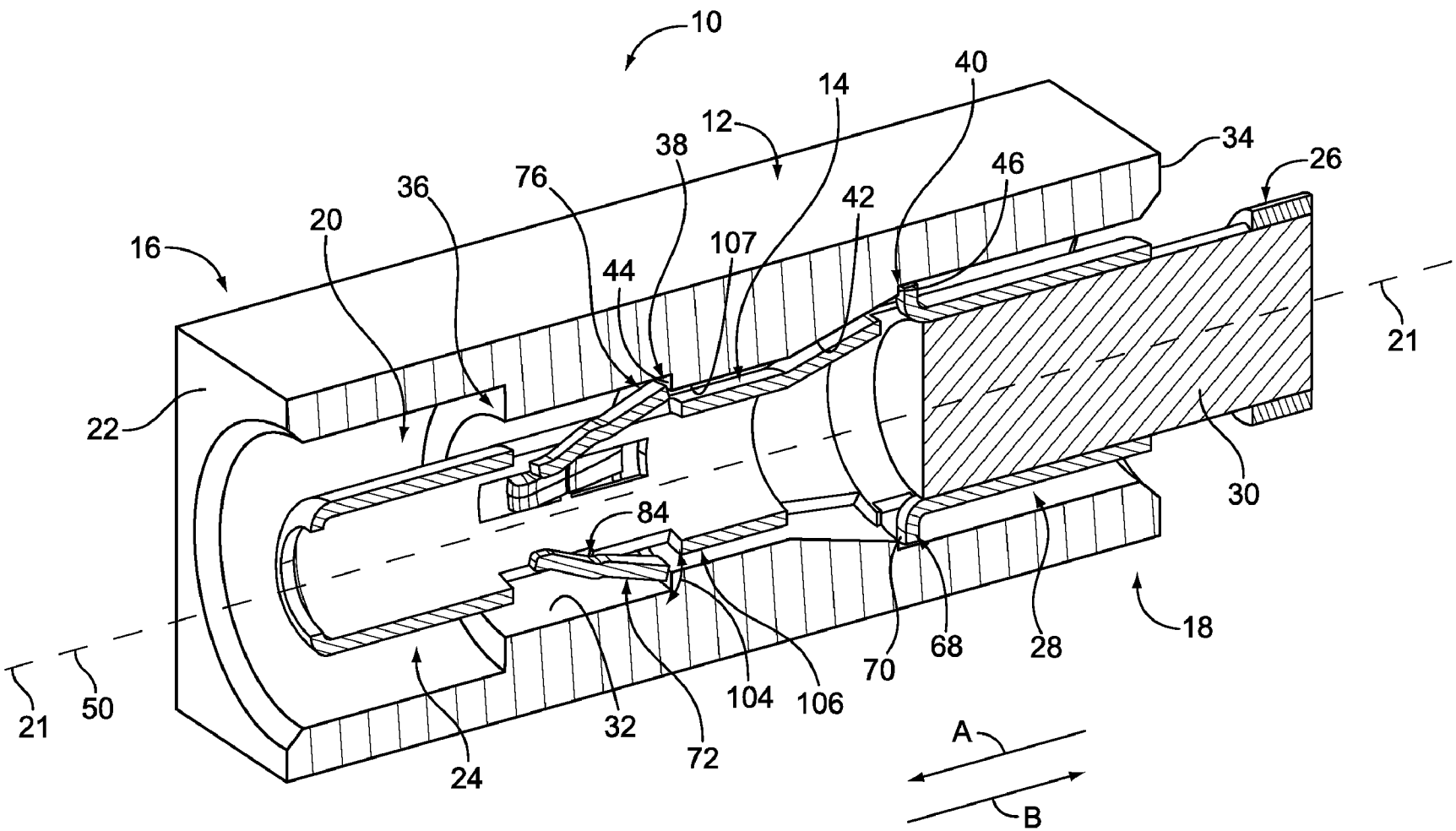
FIG. 1 is perspective view illustrating a cross section of an exemplary embodiment of an electrical connector.

FIG. 1 is perspective view illustrating a cross section of an exemplary embodiment of an electrical connector 10. The electrical connector 10 includes a housing 12 and an electrical contact 14 held by the housing 12. The housing 12 extends a length from a mating end 16 to a terminating end 18. The electrical connector 10 is configured to mate with a mating connector (not shown) at the mating end 16. When the mating end 16 of the electrical connector 10 is mated with the mating connector, the electrical contact 14 is engaged with, and thereby electrically connected to, a mating contact (not shown) of the mating connector to establish an electrical connection between the electrical connector 10 and the mating connector. The mating end 16 of the electrical connector 10 may be referred to herein as a "front end". The terminating end 18 of the electrical connector 10 may be referred to herein as a "rear end".

The housing 12 includes an internal cavity 20 extending through the length thereof from the mating end 16 to the terminating end 18. The internal cavity 20 extends a length along a central longitudinal axis 21. The mating end 16 of the housing 12 includes a front face 22 through which the internal cavity 20 extends. In the exemplary embodiment, the housing 12 receives a portion of the mating connector into the internal cavity 20 through the mating end 16 of the housing 12. In addition or alternatively, the mating connector may receive a portion of the mating end 16 of the housing 12 therein. The electrical contact 14 is held within the internal cavity 20 such that a contacting end 24 of the electrical contact 14 extends within the internal cavity 20 along the mating end 16 of the housing 12 for engagement with the mating contact of the mating connector. Although the housing 12 is shown as holding a single electrical contact 14, the housing 12 may hold any number of the electrical contacts 14, in any number of internal cavities 20, for engagement with any number of mating contacts of the mating connector.

In the exemplary embodiment, the terminating end 18 of the housing 12 terminates one or more electrical wires 26. Specifically, the electrical contact 14 includes a terminating end 28 that extends within the internal cavity 20 along the terminating end 18 of the housing 12. The electrical wire 26 includes an electrical conductor 30 that is engaged with, and thereby electrically connected to, the terminating end 28 of the electrical contact 14. The electrical wire 26 may be an individually routed wire or may be a wire grouped with other wires in a cable (not shown). Although the housing 12 is shown as terminating a single electrical wire 26, the housing 12 may terminate any number of electrical wires 26, each of which may be electrically connected to any number of electrical contacts 14. In addition or alternative to terminating the electrical wire 26, the housing 12 may be mounted on a circuit board (not shown) such that one or more electrical contacts 14 held by the housing 12 is electrically connected to the circuit board.

The internal cavity 20 is defined by one or more interior walls 32 of the housing 12. In other words, the interior wall 32 forms a portion of a boundary of the internal cavity 20. In the exemplary embodiment, the interior wall 32 extends a length from the front face 22 to a rear face 34 of the terminating end 18 of the housing 12. The interior wall 32 includes a stop shoulder 36 that engages the mating connector when the electrical connector 10 and the mating connector are fully mated together. The interior wall 32 also includes a plurality of locking shoulders 38 and 40, and a ramp surface 42. As will be described below, the locking shoulders 38 and 40 include respective locking surfaces 44 and 46 that cooperate with corresponding locking features of the electrical contact 14 to hold, or lock, that electrical contact 14 within the internal cavity 20 of the housing 12. In the exemplary embodiment, the locking surfaces 44 and 46 of the locking shoulders 38 and 40, respectively, each extend approximately perpendicular to the central longitudinal axis 21. Alternatively, the locking surface 44 extends at an acute or obtuse angle relative to the central longitudinal axis 21, and/or the locking surface 46 extends at an acute or obtuse angle relative to the central longitudinal axis 21.

Figure 2:
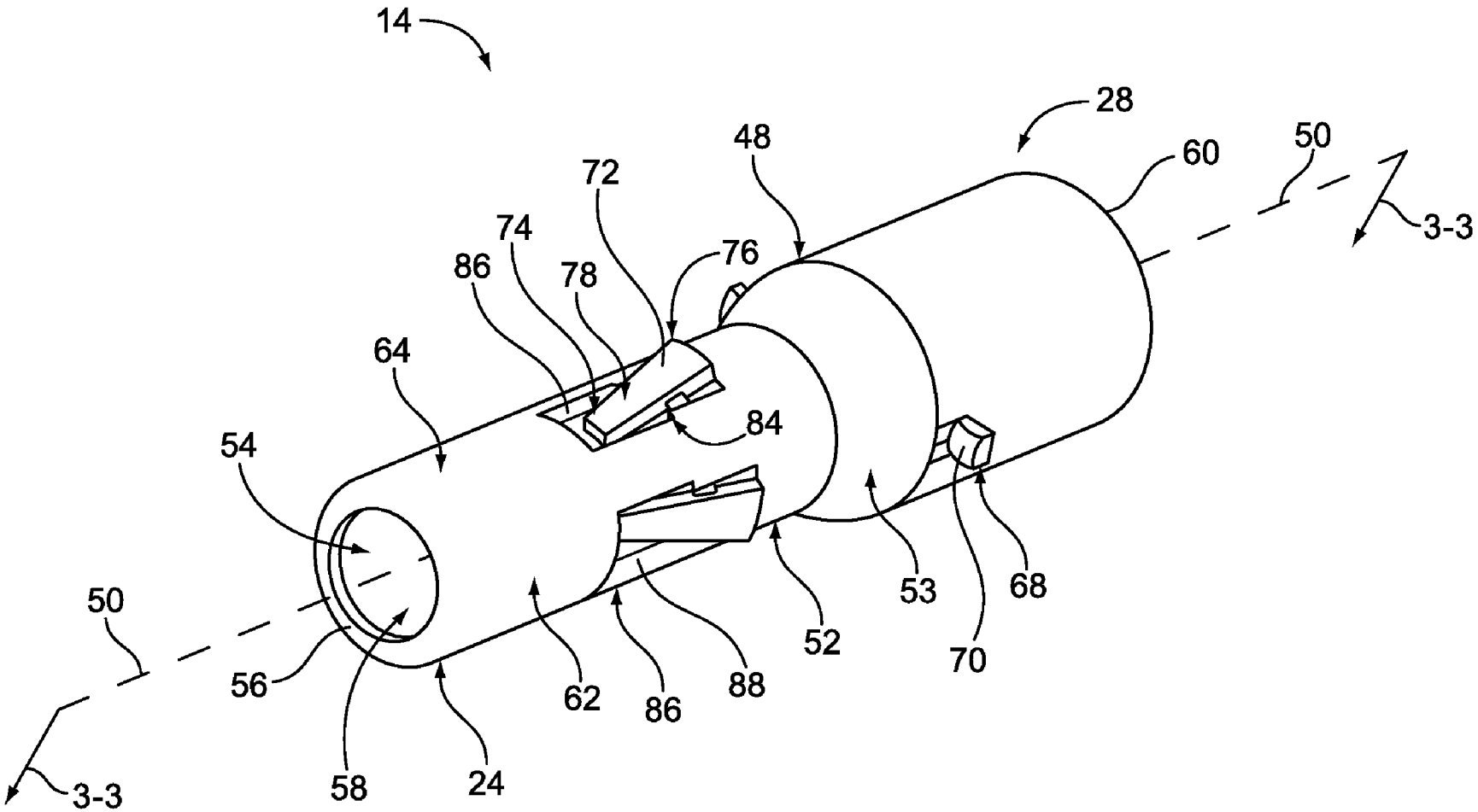
FIG. 2 is a perspective view of an exemplary embodiment of an electrical contact of the electrical connector shown in FIG. 1.
Figure 3:
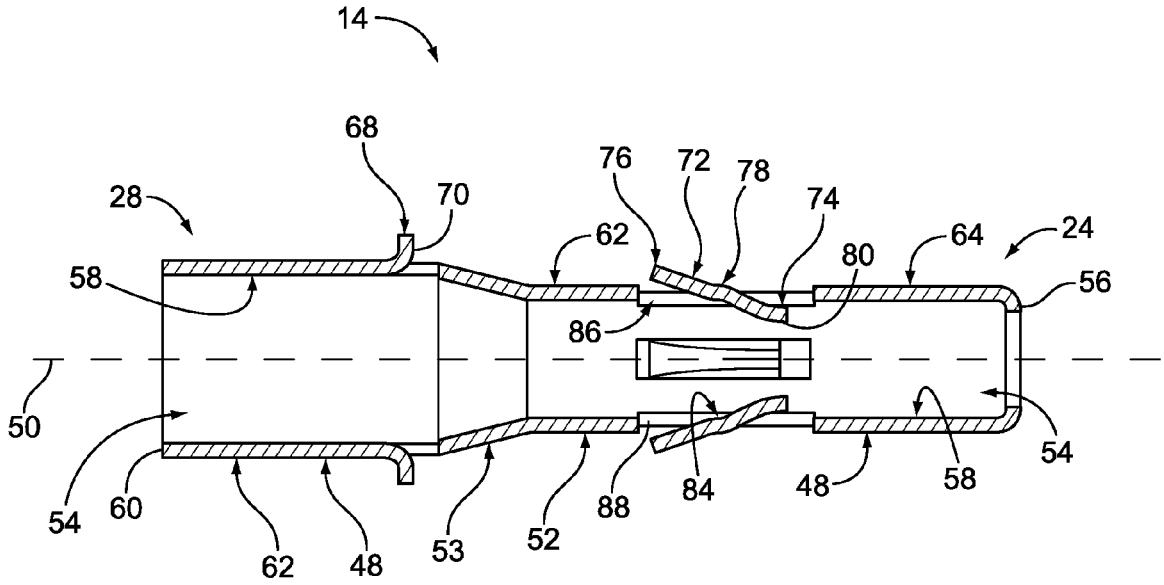
FIG. 3 is a cross sectional view of the electrical contact shown in FIG. 2 taken along line 3-3 of FIG. 2.

FIG. 2 is a perspective view of an exemplary embodiment of the electrical contact 14. FIG. 3 is a cross sectional view of the electrical contact 14 taken along line 3-3 of FIG. 2. The electrical contact 14 includes a body 48 extending a length along a central longitudinal axis 50 from the contacting end 24 to the terminating end 28. The body 48 includes a base 52 extending between the contacting end 24 and the terminating end 28. Specifically, the base 52 extends from the contacting end 24 to the terminating end 28. The base 52 includes an optional flared section 53 that engages the ramp surface 42 (FIGS. 1 and 5) of the housing 12 (FIGS. 1 and 5) when the electrical contact 14 is fully received within the internal cavity 20 (FIGS. 1 and 5) of the housing 12. In the exemplary embodiment, a passageway 54 extends through the length of the body 48. The passageway 54 extends a length along the central longitudinal axis 50 of the contact body 48. The contacting end 24 of the electrical contact 14 includes a front face 56 through which the passageway 54 extends. The passageway 54 is defined by one or more interior walls 58 of the contact body 48. In other words, the interior wall 58 forms a portion of a boundary of the passageway 54. In the exemplary embodiment, the interior wall 58 extends a length from the front face 56 to a rear face 60 of the terminating end 28 of the electrical contact 14. The contact body 48 also includes an exterior wall 62 that is opposite the interior wall 58. In the exemplary embodiment, the exterior wall 62 extends a length from the front face 56 to the rear face 60 of the contact body 48.

As described above, the contacting end 24 of the electrical contact 14 engages the mating contact (not shown) of the mating connector (not shown) when the electrical connector 10 (FIGS. 1 and 5) is mated with the mating connector. In the exemplary embodiment, the contacting end 24 of the electrical contact 14 includes a plug 64 that is received within a receptacle (not shown) of the mating contact. In addition or alternatively, the contacting end 24 of the electrical contact 14 may receive a plug (not shown) of the mating contact therein; for example, the passageway 54 may receive a plug of the mating contact therein through the contacting end 24 of the electrical contact 14.

At the terminating end 28, the passageway 54 is configured to receive the electrical conductor 30 (FIGS. 1 and 5) of the electrical wire 26 (FIGS. 1 and 5) such that the electrical conductor 30 is engaged with and electrically connected to the contact body 48. Specifically, in the exemplary embodiment, the terminating end 28 of the electrical contact 14 is crimped around electrical conductor 30 such that the electrical conductor 30 is engaged with the interior wall 58 of contact body 48. In addition or alternatively, the terminating end 28 of the electrical contact 14 may be electrically and/or mechanically connected to the electrical conductor 30 using any other structure, means, connection type, and/or the like, such as, but not limited to, using solder, configuring the terminating end 28 as an insulation displacement contact (IDC), and/or the like. Moreover, in addition or alternative to terminating the electrical wire 26, the terminating end 28 of the electrical contact 14 may be engaged with, and thereby electrically connected to, an electrical contact (not shown) of a circuit board (not shown).

The contact body 48 includes a plurality of locking tabs 68 that cooperate with the locking shoulder 40 (FIGS. 1 and 5) of the housing 12 to facilitate locking the electrical contact 14 within the internal cavity 20 of the housing 12. Specifically, in the exemplary embodiment, the terminating end 28 of the electrical contact 14 includes the locking tabs 68. Each locking tab 68 extends radially outward relative to the central longitudinal axis 50 of the contact body 48 and includes a locking surface 70 that engages the locking surface 46 (FIGS. 1 and 5) of the locking shoulder 40. Each of the locking tabs 68 may alternatively be located at any other portion of the contact body 48 than the terminating end 28, and each locking tab 68 may alternatively have any other location on the terminating end 28 than is shown herein.

In the exemplary embodiment, the locking surface 70 of each of the locking tabs 68 extends approximately perpendicular to the central longitudinal axis 50 of the contact body 48. Each locking surface 70 may alternatively extend at an acute or obtuse angle relative to the central longitudinal axis 50. Although two locking tabs 68 are shown, the contact body 48 may include any number of locking tabs 68.

The contact body 48 also includes a plurality of locking barbs 72 that cooperate with the locking shoulder 38 (FIGS. 1 and 5) of the housing 12 to facilitate locking the electrical contact 14 within the internal cavity 20 of the housing 12. In the exemplary embodiment, the locking barbs 72 are connected to the base 52 of the contact body 48. Each locking barb 72 extends a length from an engagement end 74 to a locking end 76. The locking end 76 engages the locking surface 44 (FIGS. 1 and 5) of the locking shoulder 38. An intermediate link 78 extends between the engagement end 74 and the locking end 76. Specifically, the intermediate link 78 extends from the engagement end 74 to the locking end 76. The engagement end 74 includes an engagement surface 80 (not visible in FIG. 2) that is configured to be engaged by a removal tool 82 (FIGS. 4 and 5) for removing the electrical contact 14 from the housing 12, as will be described below.

Each locking barb 72 is connected to the base 52 of the contact body 48 at a pivot point 84 that is located along the intermediate link 78. Specifically, the base 52 includes a plurality of openings 86 that each extends through the interior and exterior walls 58 and 62, respectively, and completely through the base 52 therebetween. Each opening 86 is defined by an opening surface 88 that extends from the interior wall 58 to the exterior wall 62. Each locking barb 72 extends through a corresponding one of the openings 86. The intermediate link 78 of each locking barb 72 is connected to the corresponding opening surface 88 at the pivot point 84.

Figure 5:
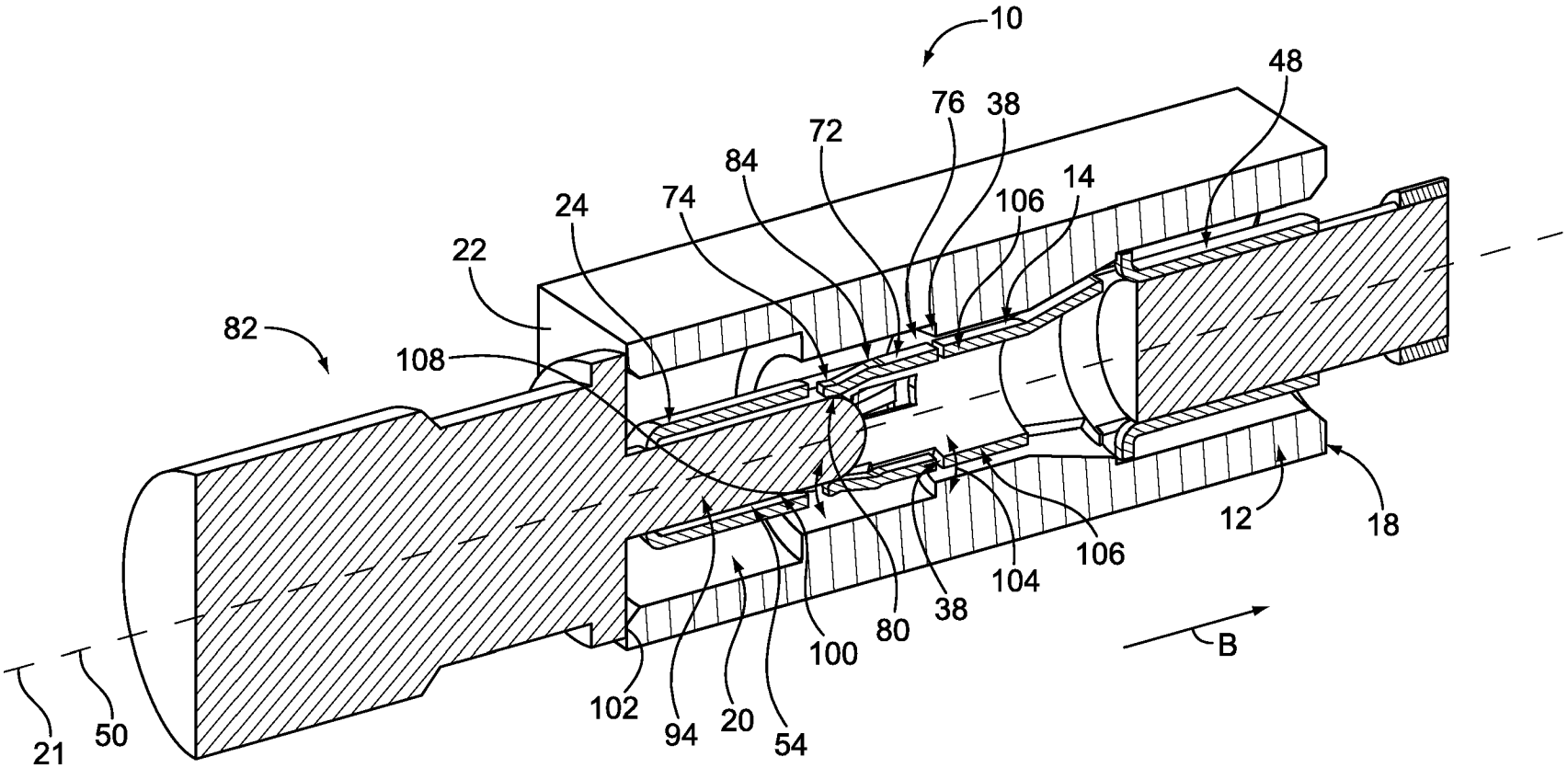
FIG. 5 is a perspective view illustrating a cross section of the electrical connector shown in FIG. 1 and the removal tool shown in FIG. 4.

Each locking barb 72 is movable between a locked position, shown in FIGS. 1-3, and an unlocked position shown in FIG. 5. Specifically, the locking barbs 72 are pivotable about the pivot points 84 between the locked and unlocked positions. The natural resting position of the locking barbs 72 is the locked position. Each locking barb 72 is resiliently moveable from the locked position to the unlocked position against a bias of the locking barb 72 to the natural resting (the locked) position. When in the locked position, the engagement end 74 of each locking barb 72 extends into the passageway 54 of the contact body 48. For example, the engagement end 74 of each locking barb 72 extends inwardly from the pivot point 84 past the interior wall 58 of the contact body 48 such that the engagement end 74 extends closer to the central longitudinal axis 50 than the interior wall 58 when in the locked position. When in the locked position, the locking end 76 of each locking barb 72 extends outwardly from the pivot point 84 past the exterior wall 62 of the contact body 48 such that the locking end 76 extends farther from the central longitudinal axis 50 than the exterior wall 62.

Each of the locking barbs 72 may alternatively be located at any other portion of the contact body 48 than the base 52, and each locking barb 72 may alternatively have any other location on the base 52 than is shown herein. In the exemplary embodiment, the contact body 48 includes four locking barbs 72. However, the contact body 48 may include any number of the locking barbs 72.

The contact body 48 may be formed using any suitable process, means, method, structure, and/or the like, such as, but not limited to, any stamping process, any cutting process, any forming process, and/or the like. The locking barbs 72 are optionally formed integrally with some or all of the remainder of the contact body 48, such as, but not limited to, with the base 52. For example, the locking barbs 72 and the base 52 may be stamped out of the same sheet of material. In some embodiments, the entirety of the contact body 48 is formed integrally, such as, but not limited to, stamping and forming the entirety of the contact body 48 out of the same sheet of material.

Figure 4:
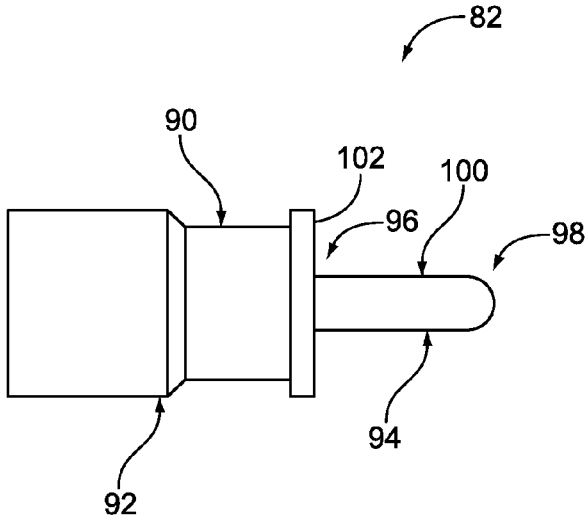
FIG. 4 is a side elevational view of an exemplary embodiment of a removal tool used to remove the electrical contact shown in FIGS. 2 and 3 from a housing of the electrical connector shown in FIG. 1.

FIG. 4 is a side elevational view of an exemplary embodiment of the removal tool 82 that may be used to remove the electrical contact 14 (FIGS. 1-3 and 5) from the housing 12 (FIGS. 1 and 5). The removal tool 82 includes a body 90 having a base 92. The base 92 is optionally sized and shaped to be grasped by a person's hand (not shown). An extension 94 extends outwardly from the base 92. The extension 94 extends a length from a base end 96, which is connected to the base 92, to a free end 98. The extension 94 is configured to be received within the passageway 54 (FIGS. 2, 3, and 5) of the electrical contact 14 through the contacting end 24 thereof. The extension 94 includes an actuation surface 100 that engages the engagement surfaces 80 (FIGS. 3 and 5) of the locking barbs 72 (FIGS. 1-3 and 5), as will be described below. The base 92 includes a mating surface 102 that engages the front face 22 (FIGS. 1 and 5) of the housing 12 when the extension 94 is fully received within the passageway 54.

Referring again to FIG. 1, to install the electrical contact 14 within the internal cavity 20 of the housing 12, the contacting end 24 of the electrical contact 14 is inserted into the internal cavity 20 through the terminating end 18 of the housing 12. As the electrical contact 14 is moved into the internal cavity 20 in the direction of the arrow A, the locking barbs 72 of the electrical contact 14 are engaged by the ramp surface 42 of the housing 12. Engagement between the locking barbs 72 and the ramp surface 42 pivots the locking barbs 72 about the corresponding pivot points 84, and against the bias of the locking barbs 72, from the locked position shown in FIG. 1 to the unlocked position (FIG. 5). Specifically, engagement between the locking barbs 72 and the ramp surface 42 moves the locking ends 76 of the locking barbs 72 along an arc 104 in a direction radially inward relative to the central longitudinal axes 21 and 50. Optionally, in the unlocked position, the locking ends 76 extend approximately coplanar with an adjacent portion 106 of the contact body 48, as can be seen in FIG. 5.

Once the electrical contact 14 has been received far enough into the internal cavity 20 such that the locking ends 76 pass the locking surface 44 of the locking shoulder 38 of the housing 12, the resilience of the locking barbs 72 returns the locking barbs 72 to the locked position. Specifically, the locking ends 76 move along the arc 104 in a direction radially outward relative to the central longitudinal axes 21 and 50. Once the locking barbs 72 have returned to the locked position, the locking ends 76 each extend radially outward past an interior surface 107 of the locking shoulder 38. Accordingly, engagement between the locking ends 76 of the locking barbs 72 and the locking surface 44 of the locking shoulder 38 will prevent the electrical contact 14 from moving within the internal cavity 20 of the housing 12 in the direction of the arrow B. When the electrical contact 14 is received within the internal cavity 20 of the housing 12 as shown in FIG. 1, the locking tabs 68 each extend radially outward past the ramp surface 42 of the housing 12. Accordingly, engagement between the locking surfaces 70 of the locking tabs 68 and the locking surface 46 of the locking shoulder 40 of the housing 12 will prevent the electrical contact 14 from moving within the internal cavity 20 of the housing 12 in the direction of the arrow A. Optionally, when the electrical contact 14 is received within the internal cavity 20 of the housing 12 as shown in FIG. 1, the locking ends 76 of the locking barbs 72 are each engaged with the locking surface 44 of the locking shoulder 38 and/or the locking surfaces 70 of the locking tabs 68 are engaged with the locking surface 46 of the locking shoulder.

FIG. 5 is a perspective view illustrating a cross section of the electrical connector 10 and the removal tool 82. To remove the electrical contact 14 from the housing 12, the extension 94 of the removal tool 82 is inserted into the passageway 54 of the electrical contact 14 through the contacting end 24 thereof. When the extension 94 is fully received within the passageway 54, the mating surface 102 of the removal tool 82 is engaged with the front face 22 of the housing 12. As the extension 94 is received into the passageway 54 in the direction of the arrow B, the actuation surface 100 of the extension 94 engages the engagement surface 80 of each of the locking barbs 72. Engagement between the engagement surfaces 80 of the locking barbs 72 and the actuation surface 100 of the extension 94 pivots the locking barbs 72 about the corresponding pivot points 84, and against the bias of the locking barbs 72, from the locked position (FIGS. 1-3) to the unlocked position shown in FIG. 5. Specifically, engagement between the engagement surface 80 and the actuation surface 100 moves the engagement ends 74 of the locking barbs 72 along an arc 108 in a direction radially outward relative to the central longitudinal axes 21 and 50. Movement of the engagement ends 74 along the arc 108 in the radially outward direction causes the locking ends 76 of the locking barbs 72 to move along the arc 104 in a direction radially inward relative to the central longitudinal axes 21 and 50. The locking ends 76 thereby move radially inward past the locking shoulder 38, such that the locking ends 76 are in the unlocked position wherein the locking ends 76 no longer engage the locking shoulder 38. In other words, the locking ends 76 clear the locking shoulder 38 such that the electrical contact 14 can be moved in the direction of the arrow B without the locking ends 76 engaging the locking shoulder 38. The electrical contact 14 can then be removed from the internal cavity 20 through the terminating end 18 of the housing 12 by moving the electrical contact 14 in the direction of the arrow B. Optionally, in the unlocked position, the locking ends 76 extend approximately coplanar with the adjacent portion 106 of the contact body 48.

The embodiments described and/or illustrated herein may provide an electrical connector having a reduced number of components than at least some known electrical connectors. The embodiments described and/or illustrated herein may provide an electrical connector having a reduced cost relative to at least some known electrical connectors. The embodiments described and/or illustrated herein may provide an electrical connector that is more easily assembled than at least some known electrical connectors. The embodiments described and/or illustrated herein may provide an electrical connector having an electrical contact that can be removed from a housing of the electrical connector by accessing a front, or mating, end of the connector. The embodiments described and/or illustrated herein may provide an electrical connector that requires less space at a rear, or terminating, end of the connector for removing an electrical contact therefrom than at least some known electrical connectors.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. When introducing elements/components/etc. described and/or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc. Moreover, the terms "first," "second," and "third," etc. in the claims are used merely as labels, and are not intended to impose numerical requirements on their objects. Dimensions, types of materials, orientations of the various components, and the number and positions of the various components described and/or illustrated herein are intended to define parameters of certain embodiments, and are by no means limiting and are merely exemplary embodiments. Many other embodiments and modifications within the spirit and scope of the claims will be apparent to those of skill in the art upon reviewing the description and illustrations. The scope of the subject matter described and/or illustrated herein should therefore be determined with reference to the appended claims, along with the full scope of equivalents to which such claims are entitled. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

While the subject matter described and/or illustrated herein has been described in terms of various specific embodiments, those skilled in the art will recognize that the subject matter described and/or illustrated herein can be practiced with modification within the spirit and scope of the claims.

What is claimed is:

1. An electrical contact comprising:

a body extending a length from a contacting end to a terminating end, the body comprising a base extending between the contacting and terminating ends;

a passageway extending through at least a portion of the length of the body along a central longitudinal axis, the passageway being at least partially defined by an interior wall of the body; and a locking barb connected to the base of the body, the locking barb extending a length from an engagement end to a locking end, the locking barb being connected to the base of the body at a pivot point located along the locking barb between the engagement and locking ends, the locking barb being pivotable about the pivot point between a locked and an unlocked position, the engagement end of the locking barb extending into the passageway of the body when the locking barb is in the locked position, wherein the locked position is the natural resting position of the locking barb, and wherein, when the locking barb is in the locked position, the engagement end of the locking barb is disposed at a distance from the central longitudinal axis that is less than a distance of the interior wall from the central longitudinal axis.

2. The electrical contact according to claim 1, wherein the base of the body comprises an opening extending therethrough, the locking barb extending through the opening.

3. The electrical contact according to claim 1, wherein the engagement end of the locking barb comprises an engagement surface configured to engage a removal tool within the passageway of the body for moving the locking barb from the locked position to the unlocked position.

4. The electrical contact according to claim 1, wherein the body comprises an interior wall that at least partially defines the passageway and an exterior wall opposite the interior wall, the engagement end of the locking barb extending inwardly from the pivot point past the interior wall of the body when the locking barb is in the locked position, the locking end of the locking barb extending outwardly from the pivot point past the exterior wall of the body when the locking barb is in the locked position.

5. The electrical contact according to claim 1, wherein the passageway extends through the length of the body along a central longitudinal axis, the body comprising an exterior wall, at least a portion of the locking end of the locking barb extending further from the central longitudinal axis than the exterior wall when the locking barb is in the locked position.

6. The electrical contact according to claim 1, wherein, when the locking barb is in the locked position, the engagement end of the locking barb extends outwardly from the pivot point directly into the passageway of the body.

7. The electrical contact according to claim 1, wherein the locking end of the locking barb extends approximately coplanar with an adjacent portion of the base of the body when the locking barb is in the unlocked position.

8. The electrical contact according to claim 1, wherein the contacting end of the body comprises a plug that is configured to be received within a receptacle of a mating contact, the contacting end of the body comprising an opening extending therethrough into fluid communication with the passageway of the body.

9. The electrical contact according to claim 1, wherein the contacting end of the body comprises a plug that is configured to be received within a receptacle of a mating contact.

10. The electrical contact according to claim 1, wherein the locking barb is formed integrally with the body.

11. An electrical connector comprising:

a housing having an internal cavity comprising a locking shoulder; and an electrical contact held at least partially within the internal cavity of the housing, the electrical contact comprising:

a body extending a length from a contacting end to a terminating end, the body comprising a base extending between the contacting and terminating ends;

a passageway extending through at least a portion of the length of the body along a central longitudinal axis, the passageway being at least partially defined by an interior wall of the body; and a locking barb connected to the base of the body, the locking barb extending a length from an engagement end to a locking end, the locking barb being connected to the base of the body at a pivot point located along the locking barb between the engagement and locking ends, the locking barb being pivotable about the pivot point between a locked position and an unlocked position, the locking barb being resiliently movable from the locked position to the unlocked position against a bias of the locking barb, the locking end of the locking barb being configured to engage the locking shoulder of the housing when the locking barb is in the locked position, the engagement end of the locking barb extending into the passageway of the body when the locking barb is in the locked position, wherein, when the locking barb is in the locked position, the engagement end of the locking barb is disposed at a distance from the central longitudinal axis that is less than a distance of the interior wall from the central longitudinal axis.

12. The electrical connector according to claim 11, wherein the base of the body comprises an opening extending therethrough, the locking barb extending through the opening.

13. The electrical connector according to claim 11, wherein, when the locking barb is in the locked position, the engagement end of the locking barb extends outwardly from the pivot point directly into the passageway of the body.

14. The electrical connector according to claim 11, wherein the passageway extends through the length of the body along a central longitudinal axis, the body comprising an exterior wall, at least a portion of the locking end of the locking barb extending further from the central longitudinal axis than the exterior wall when the locking barb is in the locked position, the locking end of the locking barb extending approximately coplanar with an adjacent portion of the base of the body when the locking barb is in the unlocked position.

15. The electrical connector according to claim 11, wherein the contacting end of the body comprises a plug that is configured to be received within a receptacle of a mating contact.

16. The electrical connector according to claim 11, wherein the contacting end of the body comprises a plug that is configured to be received within a receptacle of a mating contact, the contacting end of the body comprising an opening extending therethrough into fluid communication with the passageway of the body.

17. The electrical connector according to claim 11, wherein the locking barb is formed integrally with the body of the electrical contact.

18. The electrical connector according to claim 11, further comprising a removal tool, wherein the engagement end of the locking barb comprises an engagement surface engaged with the removal tool within the passageway of the body.

19. An electrical contact assembly comprising:

a body extending a length from a contacting end to a terminating end, the body comprising a base extending between the contacting and terminating ends;

a passageway extending through at least a portion of the length of the body;

a locking barb connected to the base of the body, the locking barb extending a length from an engagement end to a locking end, the locking barb being connected to the base of the body at a pivot point located along the locking barb between the engagement and locking ends, the locking barb being pivotable about the pivot point between a locked and an unlocked position, the engagement end of the locking barb extending into the passageway of the body when the locking barb is in the locked position; and a removal tool configured to be at least partially received within the passageway of the body into engagement with the engagement end of the locking barb, wherein engagement between the removal tool and the locking barb moves the locking barb from the locked position to the unlocked position.

* * * * *